US006074186A

United States Patent [19]

Lifson et al.

[11] Patent Number: 6,074,186

[45] Date of Patent: Jun. 13, 2000

[54] LUBRICATION SYSTEMS FOR SCROLL COMPRESSORS

[75] Inventors: Alexander Lifson; Hussein Ezzat Khalifa, both of Manlius; James W. Bush, Skaneateles, all of N.Y.

[73] Assignee: Carrier Corporation, Farmington, Conn.

[21] Appl. No.: 08/958,490

[22] Filed: Oct. 27, 1997

[51] Int. Cl.[7] ..... F01C 1/02

[52] U.S. Cl. ..... 418/55.6; 418/99

[58] Field of Search ..... 418/55.6, 94, 99

[56] References Cited

U.S. PATENT DOCUMENTS

| | | | |
|---|---|---|---|
| 4,561,832 | 12/1985 | Shimizu | 418/55 |
| 5,395,224 | 3/1995 | Caillat et al. | 418/55.6 |
| 5,447,420 | 9/1995 | Caillat et al. | 418/55.6 X |
| 5,462,419 | 10/1995 | Hill et al. | 418/55.6 X |
| 5,616,016 | 4/1997 | Hill et al. | 418/55.6 X |

FOREIGN PATENT DOCUMENTS

| | | |
|---|---|---|
| 0679809A2 | 9/1995 | European Pat. Off. . |
| 59-11391 | 6/1984 | Japan . |

OTHER PUBLICATIONS

Japanese Patent Abstract 58052375 dated Mar. 30, 1983.
Japanese Patent Abstract 57022706 dated Feb. 17, 1982.

*Primary Examiner*—Hoang Nguyen
*Attorney, Agent, or Firm*—Howard & Howard

[57] ABSTRACT

An improved scroll compressor lubrication system includes a number of embodiments wherein a lubricant port in the orbiting scroll supplies lubricant to the compression chambers throughout its entire orbiting cycle. The lubricant port is aligned with a recess in a flange of the fixed scroll throughout its entire orbiting cycle. In a further embodiment, the lubricant port is exposed to the compression chamber throughout its entire cycle. In other embodiments, the fixed scroll is provided with recesses spaced from each other by approximately 180°. The lubricant port moves sequentially into and out of communication with these spaced recesses to supply lubricant to the compression chambers.

20 Claims, 2 Drawing Sheets

LUBRICATION SYSTEMS FOR SCROLL COMPRESSORS

BACKGROUND INVENTION

This invention relates to a lubrication system for a scroll compressor wherein the amount of lubrication supplied to the compression chambers is closely controlled.

Scroll compressors are becoming widely utilized in refrigerant compression applications. As known, scroll compressors contain a fixed scroll and an orbiting scroll which have interfitting spiral wraps. The interfitting spiral wraps define chambers which are compressed as the orbiting scroll moves relative to the fixed scroll. In the prior art, lubricant is supplied to the compression chambers to assist in ensuring smooth operation of the scroll members during compression.

However, accurate supply of lubricant has proven challenging. It would be desirable to closely control the amount of lubricant supplied to the chambers. If too much lubricant is supplied, system efficiency is reduced due to impaired heat transfer in the heat exchanger from the insulating effect of the oil. On the other hand, if inadequate lubricant is supplied, then the overall operation of the scroll compressor may not be as desired.

In one known scroll compressor, a port is formed through the base of the orbiting scroll, and generally facing the outer flange of the fixed scroll. As the orbiting scroll orbits, the oil port is exposed to a compression chamber or gas passage radially inwardly of the outer flange of the fixed scroll for a portion of its orbiting cycle. During the remainder of its orbiting cycle the port faces the flange of the fixed scroll, and is thus closed.

In this compressor, lubricant is only supplied over a limited period of the cycle of the scroll compressor. Also, the flow of oil is influenced by the direction of centrifugal forces acting on the oil when the port is alternately open and closed. It would be desirable to have better control over the supply of lubricant to the compression chambers, relying on pressure differences and controlled restrictions to regulate oil flow and eliminating any influences of centrifugal forces.

SUMMARY OF THE INVENTION

In a disclosed embodiment of this invention a lubricant port is formed through the orbiting scroll base to supply lubricant to a compression chamber defined between fixed and orbiting scroll wraps. Preferably, the lubricant port is open to the compression chamber through the entire orbiting cycle of the orbiting scroll. The amount of lubricant supplied to the compression chamber is controlled by controlling the size of the lubricant port, and/or by providing a restriction to fluid flow at a location in the vicinity of the lubricant port.

In one preferred embodiment, the lubricant port faces an outer flange of the fixed scroll, which surrounds the fixed scroll wrap, throughout its entire orbiting cycle. A recess is formed in the outer flange and is aligned with the lubricant port throughout its entire orbiting cycle. The depth and size of the recess is controlled to provide a restriction to the amount of lubricant which flows from the port into the compression chambers. In one most preferred embodiment, the recess includes a first circular portion which corresponds to the movement of the lubricant port during orbiting movement of the orbiting scroll. A neck portion extends from the circular portion to a wall of the flange to communicate with the compression chamber. Lubricant thus flows from the lubricant port, into the circular portion, and through the neck portion into the compression chamber.

By controlling the depth and diameter of the circular portion and/or depth and width of the neck portion, and also by controlling the diameter and length of the lubricant port, one can control the amount of restriction to flow of lubricant into the compression chamber. In this way, the invention can achieve a closely controlled volume of lubricant flow to the compression chamber.

In a second preferred embodiment, the circular portion is positioned such that it communicates with an edge of the outer flange such that the lubricant can flow directly from the circular portion into the compression chambers.

In another general type of scroll compressor, the lubricant port is not always open to the compression chamber. Instead, a pair of opposed grooves are formed in the fixed scroll flange spaced approximately 180° out of phase from each other. The lubricant port alternately communicates with the grooves, and then has an intermediate closed portion of its cycle until it reaches the other groove. By positioning these groves 180° out of phase, any effect of centrifugal forces on the lubricant is eliminated and cancelled. In one embodiment, each of the opposed grooves includes a circular portion and a neck. In a second embodiment, the lubricant port may only partially cross the 180° out of phase positioned grooves, such that only a portion of the port ever actually crosses them. The several embodiments provide additional restriction options to control the amount of lubricant supplied to the compression chamber.

In a third general type of scroll compressor, the lubricant port is always open to the compression chamber or gas passage. Throughout its entire cycle the port supplies lubricant to the compression chamber or gas passage. The amount of lubricant supplied to the compression chamber or gas passage is controlled by controlling the diameter and length of the lubricant port. These and other features of the present invention can be best understood from the following specification and drawings, of which the following is a brief description.

DETAILED DESCRIPTION OF PREFERRED EMBODIMENT

Figure 1:
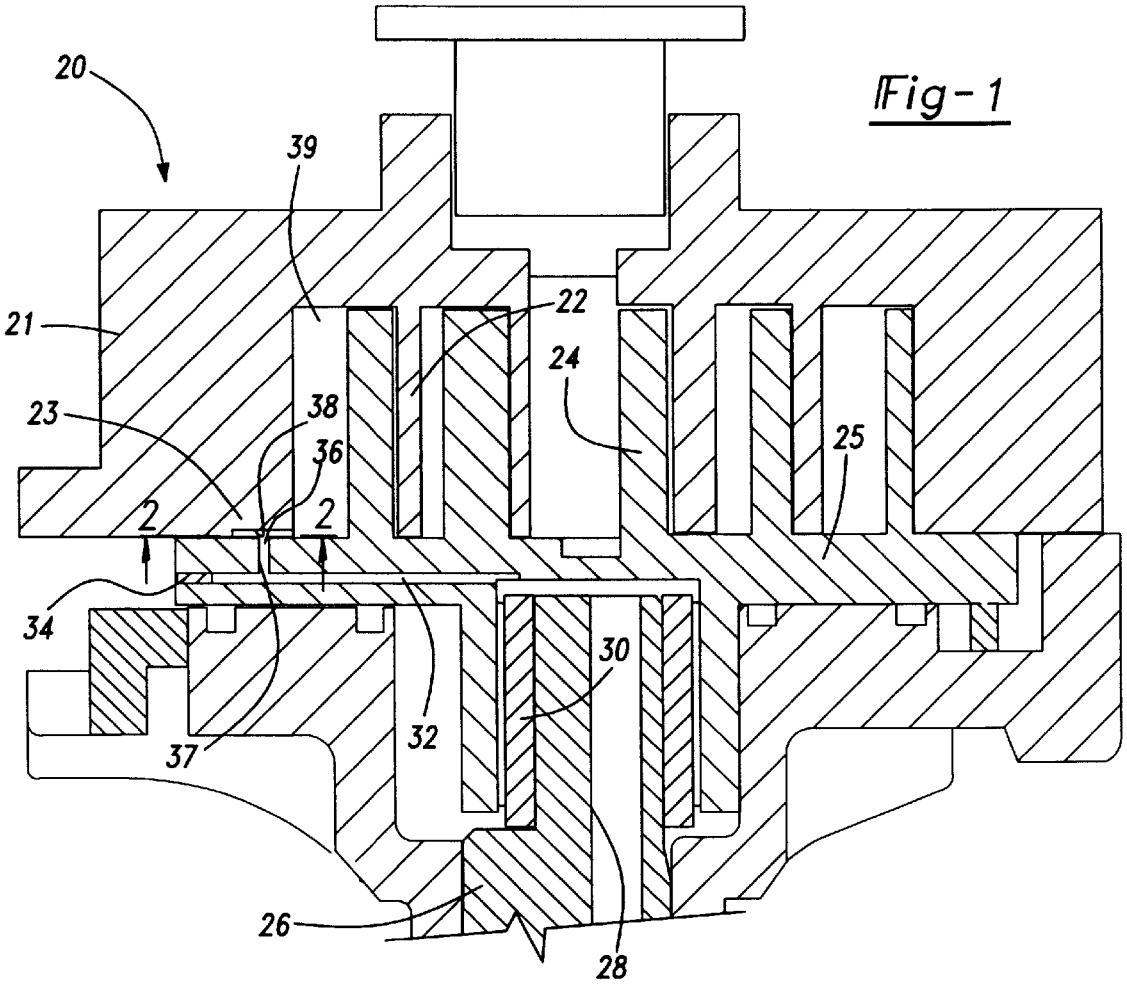
FIG. 1 shows a cross sectional view through a first embodiment of the present invention.

A scroll compressor 20 is shown in FIG. 1 including a fixed non-orbiting scroll member, shown here as a scroll 21 having an outer flange 23 and a spiral wrap 22. An orbiting scroll 25 has its wrap 24 interfitting with the wrap 22 of the fixed scroll 21. As shown, a drive shaft 26 includes a lubricant passage 28 supplying lubricant upwardly through a bearing 30 and to a passage 32 extending through the base of the orbiting scroll 25. As shown, passage 32 is closed by a plug 34 at a remote end. A passage 37 extends through the base and leads to an oil port 36. A recess 38 is formed in the flange 23 of the fixed scroll 22, and communicates with a chamber 39 formed radially inwardly of the flange 23.

Figure 2A:
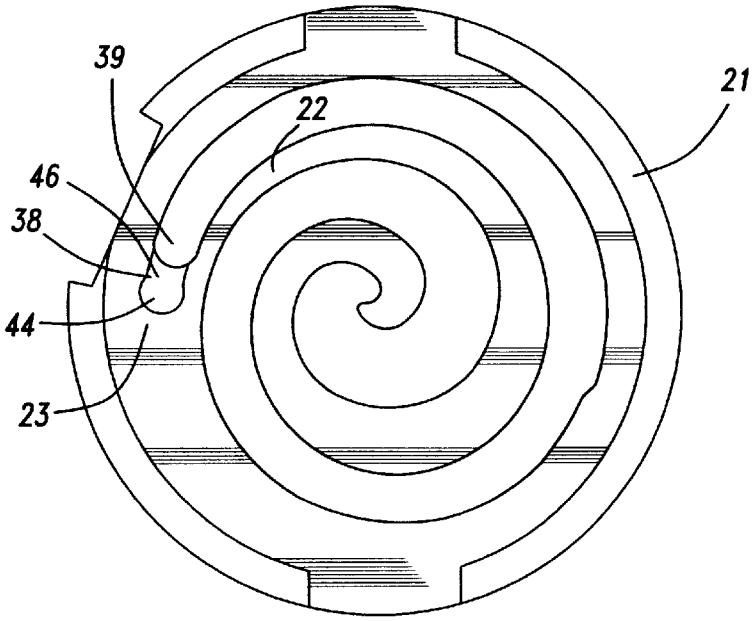
FIG. 2A is an end view along line 2—2 of the first embodiment.

As shown in FIG. 2A, recess 38 includes a circular portion 44 leading to a neck portion 46. While the two portions are shown having the same depth in FIG. 1, they may have differing depths.

Figure 2B:
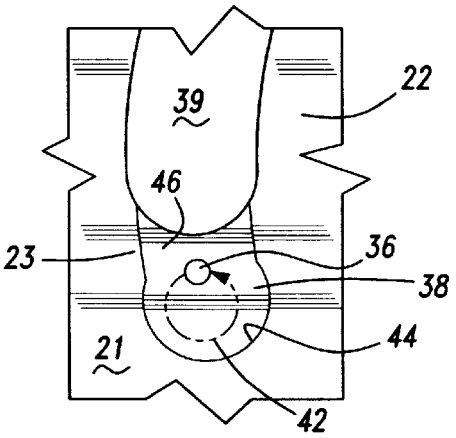
FIG. 2B is a detail of FIG. 2A.

The port 36 has its orbiting movements shown at path 42 in FIG. 2B. As shown, the entire orbiting movement of the port 36 is preferably within the circular portion 44. Neck portion 46 leads into the compression chamber or gas passage 39. Preferably, recess 38 is formed directly circumferentially beyond the end of chamber 39. If recess 38 was positioned radially outwardly of chamber 39, then additional radial space would be necessary. Placing the notch directly circumferentially beyond the end of the compression chamber or gas passage provides an efficient use of the space in the fixed scroll, and minimizes necessary radial space.

During orbiting movement of the orbiting scroll 25, port 36 moves along path 42 within the circular portion 44. Lubricant is supplied to the circular portion 44, through the neck portion 46, and into the chamber 39.

Figure 3:
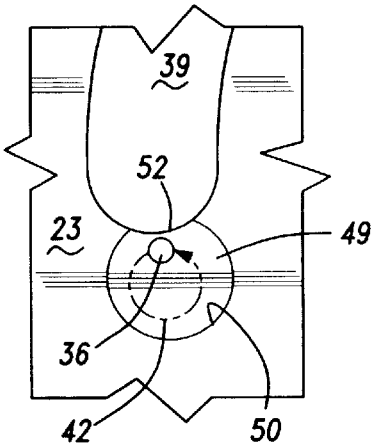
FIG. 3 shows a second embodiment.

FIG. 3 shows a second embodiment recess 49 in which the circular portion 50 is placed close to an edge 52 of flange 23. As shown, portion 50 actually crosses edge 52 and communicates directly to chamber 39. Preferably the path 42 of the lubricant port 36 remains over recess 49 and the fixed scroll, and does not move over the chamber 39. Thus, lubricant flows from port 36 into the circular portion 50, and then into chamber 39.

Figure 4:
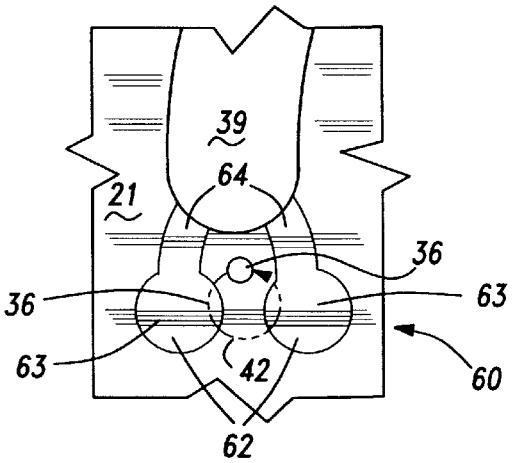
FIG. 4 shows the third embodiment.

FIG. 4 shows yet another embodiment 60 in which there are two opposed recesses 62 spaced approximately 180° out of phase from each other. The recesses 62 have circular portions 63 leading to neck portions 64 which in turn lead to the chamber 39. The lubricant port 36 moves through its orbiting path 42, and communicates with each circular portion 63 through a limited portion of orbiting movement. During the portions when lubricant port 36 is not aligned with one of the two recesses 62, lubricant flow is blocked.

Figure 5:
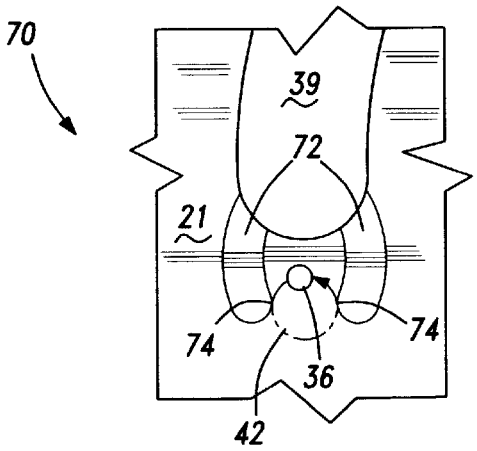
FIG. 5 shows a fourth embodiment.

FIG. 5 shows yet another embodiment 70 wherein two opposed recesses 72 are spaced approximately 180° out of phase. Edges 74 of the recesses 72 which are spaced close to each other communicate with only a small portion of lubricant port 36. That is, port 36 does not fully pass over recesses 72. Thus, further restriction to the amount of lubricant which flows into the recesses 72 is provided by this embodiment.

Figure 6:
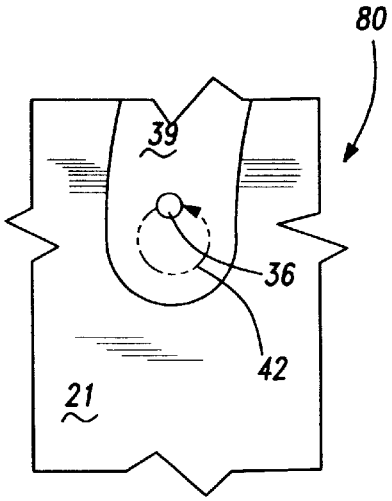
FIG. 6 shows a fifth embodiment.

FIG. 6 shows yet another embodiment 80 wherein the lubricant port 36 has its orbital path 42 always exposed to the chamber 39. In this embodiment, there is no restriction to flow from a recess, or other structure. The amount of lubricant supplied to chamber 39 is controlled by controlling the diameter of the port 36.

Recesses 38, 49, 62 and 72, are preferably of a depth between two millimeters to five microns. More preferably the recess depth is between one millimeter and ten microns.

The present invention discloses embodiments such as shown in FIG. 2A, 3, and 6 wherein lubricant is supplied throughout the entire orbital movement of the orbiting scroll. In these embodiments, the designer can closely control the amount of lubricant delivered to the compression chamber or gas passage, neither relying on nor being restricted by centrifugal force.

FIGS. 4 and 5 show a second type of lubricant system wherein the lubricant port is not always open to the compression chamber or gas passage. However, since opposed lubricant recesses are spaced 180° from each other, any effect of centrifugal force is cancelled.

Preferred embodiments of this invention have been disclosed, however, a worker of ordinary skill in the art would recognize that certain modifications would come within the scope of this invention. For that reason the following claims should be studied to determine the true scope and content of this invention.

What is claimed is:

1. A scroll compressor comprising:

a non-orbiting scroll having a base and a spiral wrap extending from said base;

an orbiting scroll having a base and a spiral wrap extending from said base and toward said fixed scroll base, said spiral wraps of said orbiting and fixed scrolls interfitting to define compression chambers, said orbiting scroll cyclically moving relative to said fixed scroll; and a lubricant supply system for supplying lubricant to a passage extending through said base of said orbiting scroll, and to a lubricant port which faces said fixed scroll, said lubricant port being open to supply lubricant to a space defined between said fixed and orbiting scroll throughout the entire cycle of orbiting movement of said orbiting scroll.

2. A scroll compressor as recited in claim 1, wherein said non-orbiting scroll has an outer flange surrounding an outermost portion of said non-orbiting scroll wrap, a recess formed in said flange at a location spaced circumferentially adjacent an outermost end of said space, and said lubricant port facing said recess such that said outermost portion is open to said port throughout the entire orbiting movement of said orbiting scroll.

3. A scroll compressor as recited in claim 1, wherein said non-orbiting scroll is formed with a recess extending into a face of said non-orbiting scroll, and communicating with said space, said lubricant port facing said recess throughout its entire orbiting cycle of orbiting movement such that lubricant is supplied through said lubricant port and into said recess, and from said recess into said space.

4. A scroll compressor as recited in claim 3, wherein said recess has a generally enlarged portion, with a smaller neck portion extending from said enlarged portion to communicate with said space, said lubricant port being aligned with said enlarged portion throughout its said cycle of orbiting movement.

5. A scroll compressor as recited in claim 3, wherein said recess includes a truncated circular portion extending across an edge of said fixed scroll such that said recess communicates with said space, and said lubricant port being aligned with said recess throughout said cycle of orbiting movement.

6. The scroll compressor as recited in claim 3, wherein said recess has a depth of between two millimeters and five microns.

7. The scroll compressor as recited in claim 1, wherein said lubricant port is exposed to said space throughout said cycle of orbiting movement.

8. A scroll compressor comprising:

a non-orbiting scroll having a base and a spiral wrap extending from said base;

an orbiting scroll having a base and a spiral wrap extending from said base and toward said non-orbiting scroll base, said spiral wraps of said orbiting and non-orbiting scrolls interfitting to define compression chambers, said orbiting scroll cyclically moving relative to said non-orbiting scroll;

said non-orbiting scroll having a recess in a flange portion which surrounds a space defined by said interfitting wraps; and a lubricant port extending through said base of said orbiting scroll, said lubricant port communicating with a lubricant source, said lubricant port facing said recess, of said non-orbiting scroll throughout the entire orbiting cycle of said orbiting scroll.

9. A scroll compressor as recited in claim 8, wherein said lubricant port is exposed to said recess throughout said entire orbiting cycle.

10. A scroll compressor as recited in claim 9, wherein said recess has a generally enlarged portion, with a smaller neck portion extending from said enlarged portion to communicate with said space, said lubricant port being exposed to said enlarged portion throughout said entire orbiting cycle.

11. A scroll compressor as recited in claim 9, wherein said recess includes a truncated circular portion extending across an edge of said non-orbiting scroll such that it communicates with said space.

12. A scroll compressor as recited in claim 8, wherein said recess includes a pair of spaced recess portions, said recess portions having enlarged portions spaced away from an edge of said flange portion, and smaller portions extending from said enlarged portions to communicate with said space at said edge, said lubricant port moving through said cycle to communicate with said enlarged portions of said two notches, and said lubricant port being closed as it moves between said enlarged portions of said two recesses.

13. A scroll compressor as recited in claim 12, wherein said two recesses are spaced approximately 180° out of phase from each other.

14. A scroll compressor as recited in claim 8, wherein said recess is provided by two recesses spaced from each other by approximately 180°, and said lubricant port being positioned such that only a portion of said port crosses said recesses during a limited portion of its orbiting cycle.

15. A scroll compressor as recited in claim 8, wherein said recess is provided by two recesses spaced from each other by approximately 180°.

16. A scroll compressor comprising:

a non-orbiting scroll having a base and a spiral wrap extending from said base, a flange surrounding said wrap, a recess formed into said flange;

an orbiting scroll having a base and a spiral wrap extending from said base and toward said non-orbiting scroll base, said spiral wraps of said orbiting and non-orbiting scrolls interfitting to define chambers, said orbiting scroll cyclically moving relative to said non-orbiting scroll; and a lubricant supply system for supplying lubricant to a passage extending through said base of said orbiting scroll, and to a lubricant port which faces said non-orbiting scroll, said lubricant port exposed to said recess to supply lubricant to one of said chambers defined between said wraps of said non-orbiting and orbiting scrolls throughout the entire cycle of orbiting movement of said orbiting scroll.

17. A scroll compressor as recited in claim 16, wherein said recess has a generally enlarged portion, with a smaller neck portion extending from said enlarged portion to communicate with said chamber, said lubricant port being exposed to said enlarged portion throughout said entire cycle.

18. A scroll compressor as recited in claim 16, wherein said recess includes a truncated circular portion extending across an edge of said fixed scroll such that it communicates with said chamber.

19. The scroll compressor as recited in claim 16, wherein said recess has a depth of between two millimeters and five microns.

20. A scroll compressor as recited in claim 8, wherein said recess has a depth of between two millimeters and five microns.

* * * * *